US011980257B2

(12) United States Patent
Wolfinbarger et al.

(10) Patent No.: US 11,980,257 B2
(45) Date of Patent: May 14, 2024

(54) CENTER RELEASE BUCKLE WITH SYMMETRIC LOCKING FEATURES

(71) Applicant: Goliath IP Stichting, Hattem (NL)

(72) Inventors: Ryan Arthur Wolfinbarger, Avon, IN (US); James Vangel Balam, Virginia Beach, VA (US)

(73) Assignee: GOLIATH IP STICHTING, Hattem (NL)

( * ) Notice: Subject to any disclaimer, the term of this patent is extended or adjusted under 35 U.S.C. 154(b) by 0 days.

(21) Appl. No.: 17/938,669

(22) Filed: Oct. 6, 2022

(65) Prior Publication Data

US 2024/0115012 A1 Apr. 11, 2024

(51) Int. Cl.
*A44B 11/26* (2006.01)

(52) U.S. Cl.
CPC ..... *A44B 11/266* (2013.01)

(58) Field of Classification Search
CPC .. A44B 11/263; A44B 11/266; A44B 11/2592
See application file for complete search history.

(56) References Cited

U.S. PATENT DOCUMENTS

| | | | | |
|---|---|---|---|---|
| 1,197,431 | A * | 9/1916 | Barrett, Sr. | A44B 11/001 24/DIG. 38 |
| 2,392,659 | A * | 1/1946 | Gore | A44B 11/2588 24/DIG. 38 |
| 4,398,324 | A | 8/1983 | Bakker et al. | |
| 5,224,247 | A | 7/1993 | Collier | |
| 5,546,642 | A | 8/1996 | Anscher | |
| D481,330 | S | 10/2003 | Fildan et al. | |
| 8,726,850 | B2 | 5/2014 | Rosenquist et al. | |
| D739,785 | S | 9/2015 | Fildan et al. | |
| 9,730,495 | B2 | 8/2017 | Howell | |
| 2017/0318912 | A1* | 11/2017 | Le Breton | A44B 11/263 |

FOREIGN PATENT DOCUMENTS

| | | |
|---|---|---|
| FR | 3 081 296 | 4/2022 |
| TW | M590381 | 2/2020 |

* cited by examiner

*Primary Examiner* — Robert Sandy
(74) *Attorney, Agent, or Firm* — LaMORTE & ASSOCIATES P.C.

(57) ABSTRACT

A buckle assembly that utilizes two molded plastic buckle constructs. The two buckle constructs are separate and distinct but are identical in size and configuration. Each of the buckle constructs has a base and two loop structures that extend as parallel cantilevers from the base. On each buckle construct, there is a gap space disposed between the loop structures. The gap space is sized to receive the loop structure from a second identical buckle construct. When two buckle constructs are brought together, the loop structures intermesh and interlock, therein mechanically joining the two buckle constructs together. A locking tab is provided in one of the loop structures on each buckle construct. The locking tab can be manually depressed to release the mechanical interconnection between the buckle constructs. The buckle constructs can then be easily separated.

11 Claims, 8 Drawing Sheets

CENTER RELEASE BUCKLE WITH SYMMETRIC LOCKING FEATURES

BACKGROUND OF THE INVENTION

1. Field of the Invention

In general, the present invention relates to the structure of buckles and connectors that are traditionally used to connect separate lengths of strap. More particularly, the present invention relates to two-piece buckles, wherein each piece of the buckle is designed to slide into the other and interconnect.

2. Prior Art Description

Molded plastic buckles are commonly used to connect sections of strap or to attach objects together. Molded plastic buckles are typically either side release buckles or center release buckles. Side release buckles open when the sides of the closed buckle are squeezed together. Such side release buckles are exemplified by U.S. Pat. No. 5,546,642 to Anscher. Center release buckles open when a button in the center of the buckle is depressed. Such center release buckles are exemplified by U.S. Pat. No. 4,398,324 to Bakker et al.

A feature shared by both side release buckles and center release buckles is that the buckles have a male half and a female half that can selectively interconnect. Accordingly, the two halves of the buckle are not identical. As a result, the two halves of the buckle must be molded in separate mold cavities. Furthermore, when attaching objects together using the buckles, there must be male/female alignment. That is, a male half of a buckle must be brought into contact with a female half of a buckle. Two male buckle halves cannot interconnect, nor can two female buckle halves interconnect.

There are situations where providing male/female buckle alignment is problematic. For example, suppose a backpack system is being used that contains various buckle attachment points. Some of the buckle attachment points may be male and others may be female. When a person purchases auxiliary equipment to attach to the backpack, the consumer may not be able to connect the auxiliary equipment to the locations desired due to lack of male/female alignment. The same problem often occurs on boats, motorcycles, ATVs, and other platforms that are outfitted with a variety of secondary objects that are attached by straps.

A need therefore exists for a low-cost molded buckle assembly that has two identical halves. In this manner, any buckle half can connect to any other buckle half without concern of male/female alignment. Furthermore, the full buckle assembly can be made using the same mold cavities, therein reducing the cost of manufacture. These needs are met by the present invention as described and claimed below.

SUMMARY OF THE INVENTION

The present invention is a buckle assembly that utilizes two molded plastic buckle constructs. The two buckle constructs are separate and distinct but are identical in size and configuration. Each of the buckle constructs has a base and two loop structures that extend as parallel cantilevers from the base. On each buckle construct, there is a gap space disposed between the loop structures. The gap space is sized to receive the loop structure from a second identical buckle construct.

When two buckle constructs are brought together, the loop structures intermesh and interlock, therein mechanically joining the two buckle constructs together. A locking tab is provided in one of the loop structures on each buckle construct. The locking tab can be manually depressed to release the mechanical interconnection between the buckle constructs. The buckle constructs can then be easily separated.

BRIEF DESCRIPTION OF THE DRAWINGS

For a better understanding of the present invention, reference is made to the following description of are exemplary embodiment thereof, considered in conjunction with the accompanying drawings, in which.

DETAILED DESCRIPTION OF THE DRAWINGS

Although the present invention buckle assembly can be embodied in many ways, only one exemplary embodiment is illustrated. The exemplary embodiment is being shown for the purposes of explanation and description. The exemplary embodiment is selected in order to set forth one of the best modes contemplated for the invention.

The illustrated embodiment, however, is merely exemplary and should not be considered a limitation when interpreting the scope of the appended claims.

Figure 1:
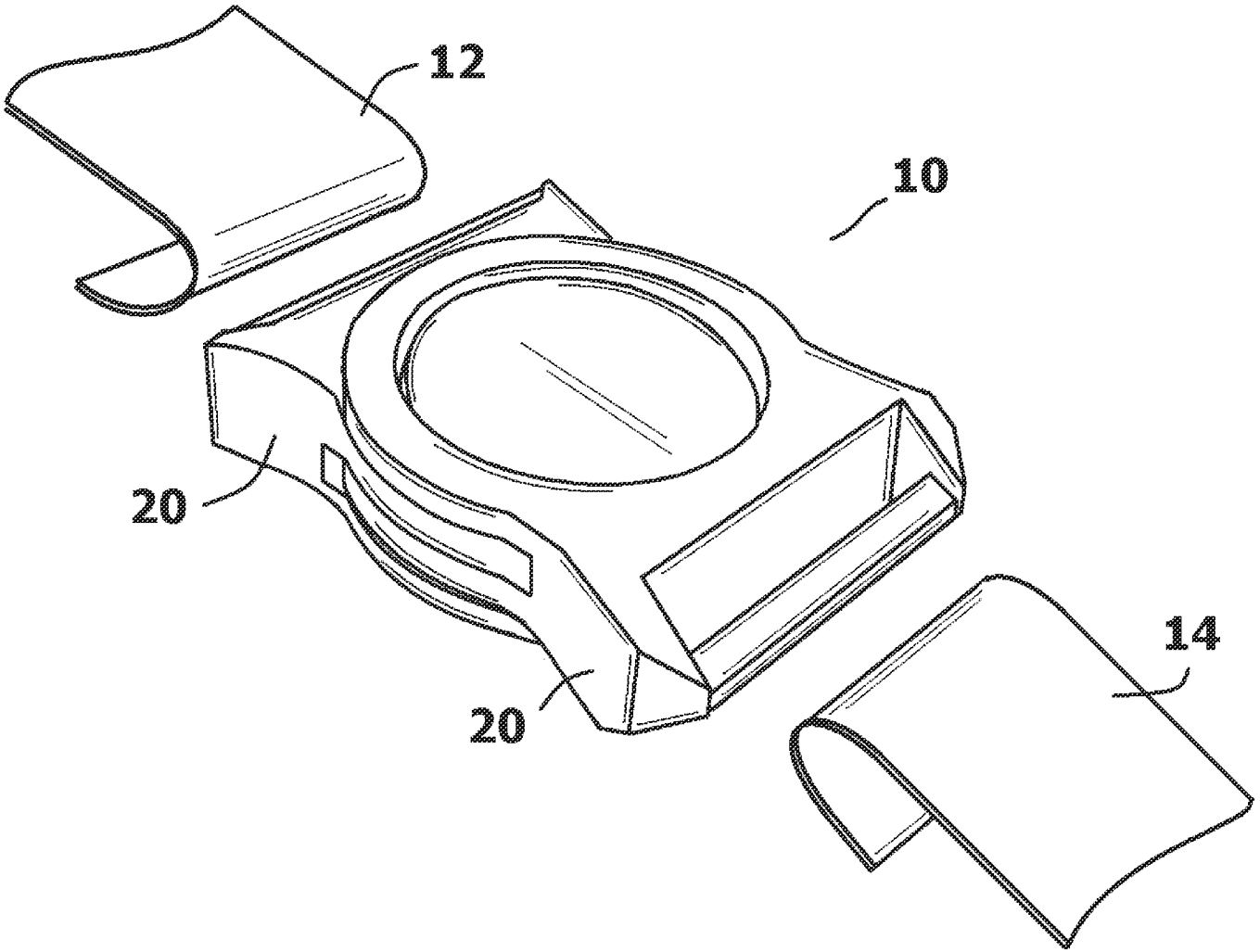
FIG. 1 is a perspective view of an exemplary embodiment of a buckle assembly in a connected state.
Figure 2:
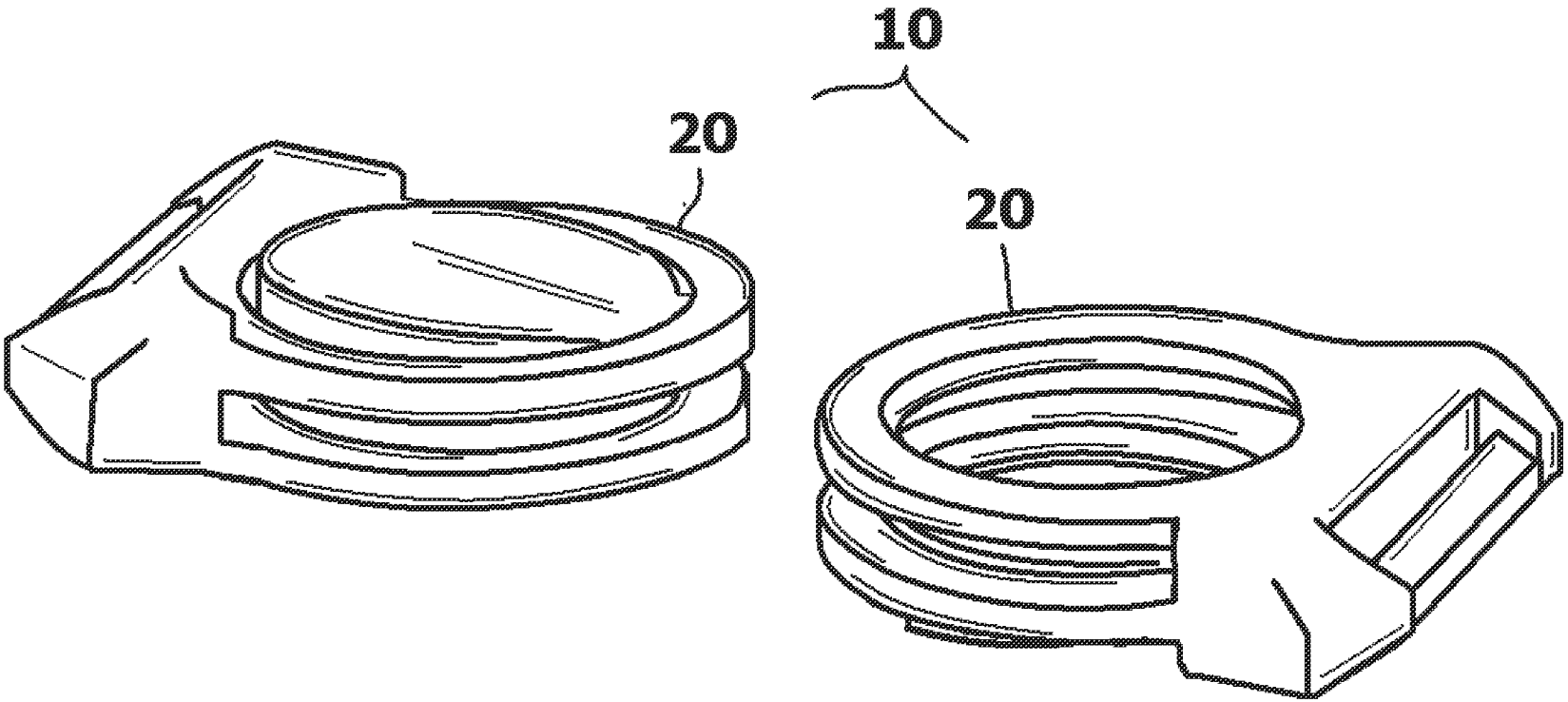
FIG. 2 is a perspective view of the exemplary embodiment of the buckle assembly in an open state.

Referring to FIG. 1 and FIG. 2, a buckle assembly is shown. The buckle assembly 10 is used to selectively interconnect a first strap 12 to a second strap 14. The buckle assembly 10 contains two buckle constructs 20 that selectively interconnect and interlock to mechanically join the first strap 12 to the second strap 14. One unique feature of the buckle assembly 10 is that both buckle constructs 20 are identical in shape, size, and construction. There is neither a male half nor a female half, as is prominent in the prior art. Rather, both buckle constructs 20 have the same symmetric features that enable the buckle constructs 20 to intermesh and interlock. Such a construction has inherent advantages. Both buckle constructs 20 can be molded from the same mold. This significantly reduces the costs of manufacturing. Furthermore, a strap terminated with a buckle construct can interconnect with any other strap terminated with the same buckle construct 20 without concern of male/female structural alignment.

Figure 3:
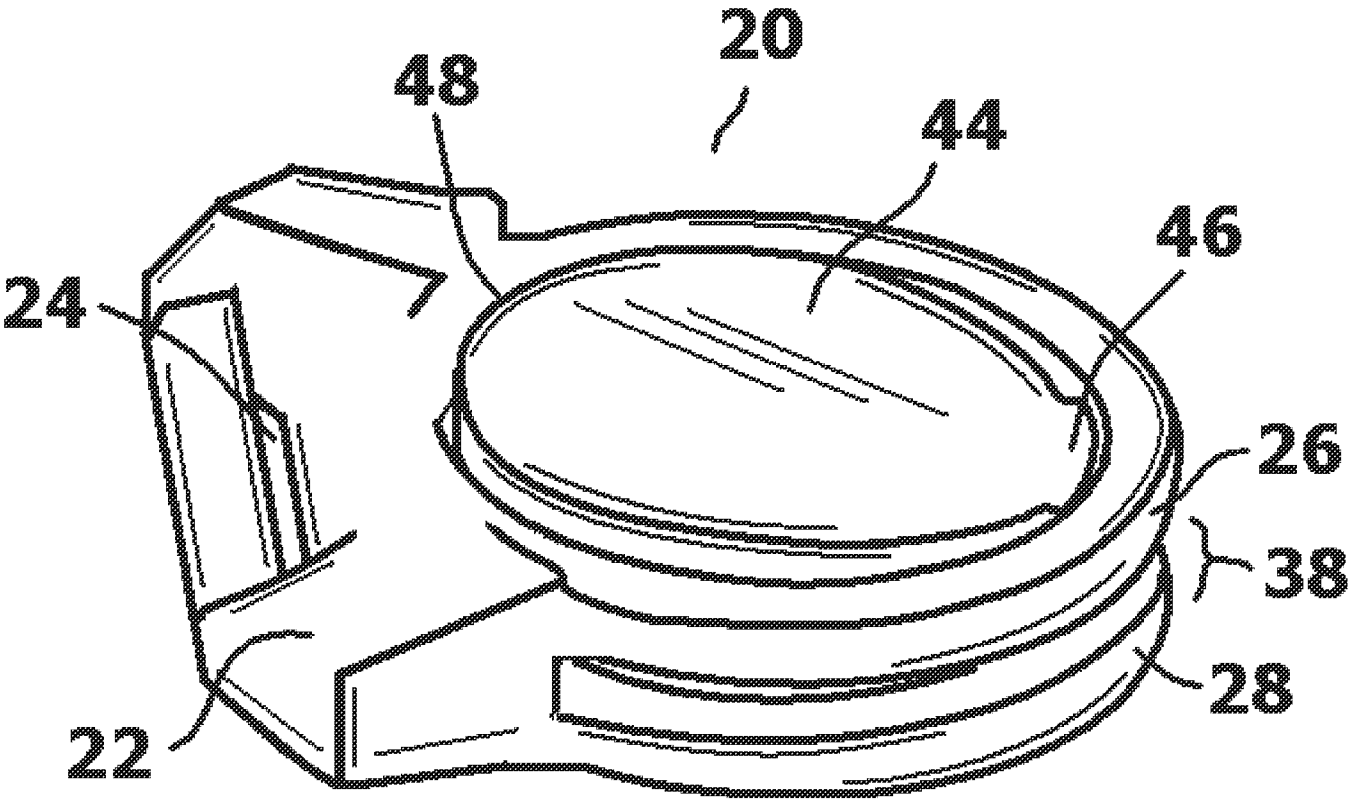
FIG. 3 is a top perspective view of a single buckle construct used in the exemplary buckle assembly.
Figure 4:
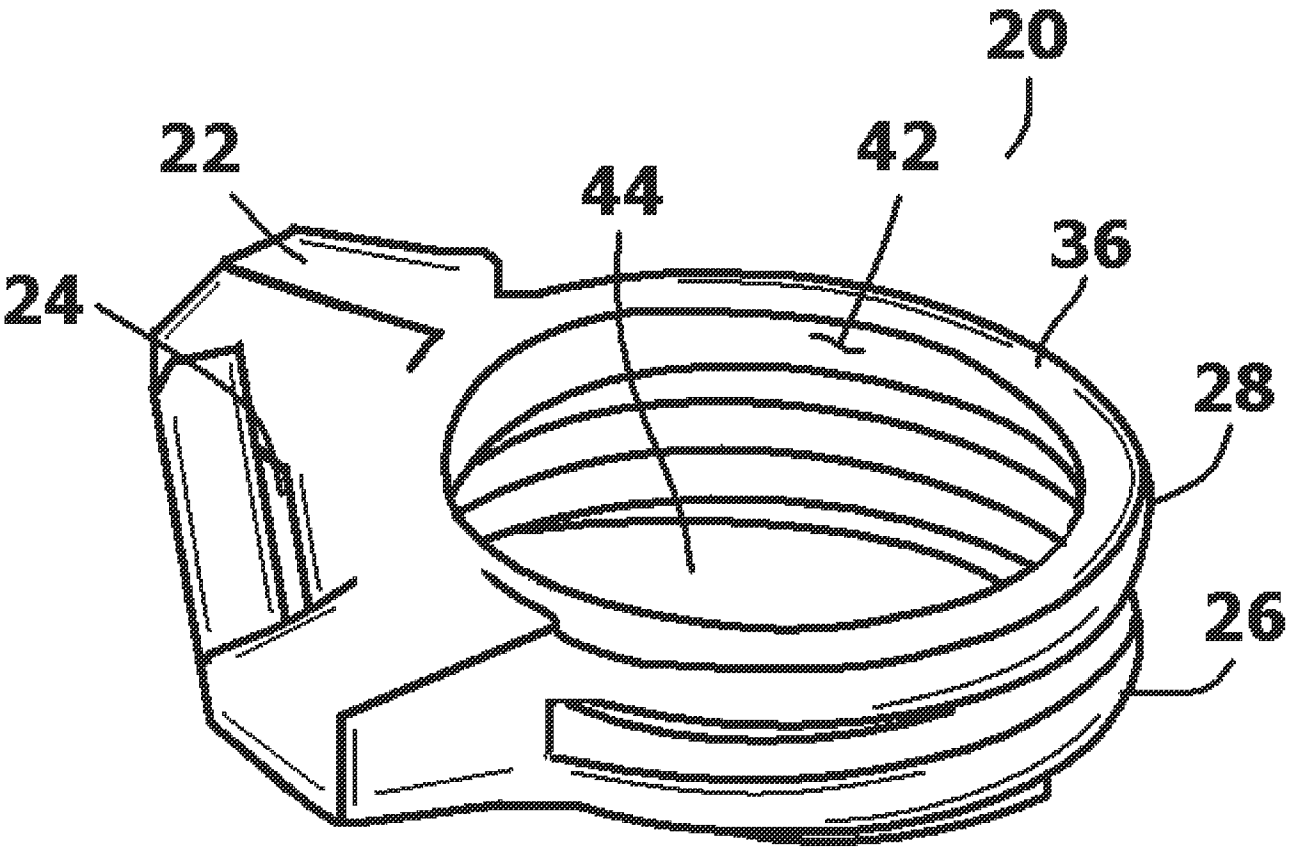
FIG. 4 is a lower perspective view of the buckle construct of FIG. 3.
Figure 5:
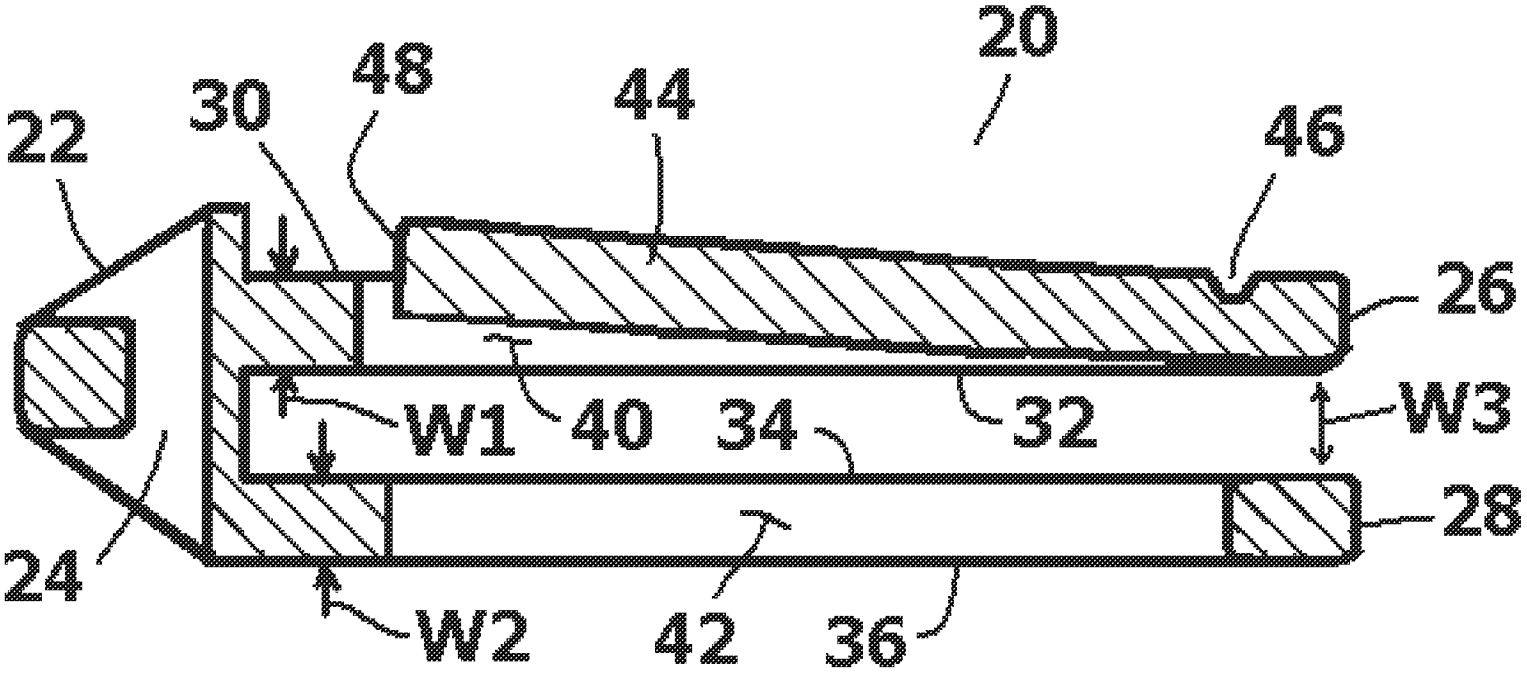
FIG. 5 is cross-sectional view of the buckle construct of FIG. 3 and FIG. 4.

Referring to FIG. 3, FIG. 4, and FIG. 5, the details of the buckle construct 20 are shown. The buckle construct 20 has a base 22. A slot 24 is formed in the base 22 to facilitate the passage of a strap and the connection of a strap to the buckle construct 20. Two loop structures 26, 28 extend from the base 22 in a common direction. The loop structures 26, 28 include a first loop structure 26 and a second loop structure 28. Both loop structures 26, 28 are concentrically aligned and have the same peripheral shape. The first loop structure 26 and the second loop structure 28 extend in parallel from the base 22. The first loop structure 26 has a uniform width W1 disposed between a flat top surface 30 and an opposite flat bottom surface 32. The second loop structure 28 also has a uniform width W2 disposed between a flat top surface 34 and an opposite bottom surface 36. The width W1 of the first loop structure 26 is the same as the width W2 of the second loop structure 28. The bottom surface 32 of the first loop structure 26 faces the top surface 34 of the second loop structure 28. The two surfaces 32, 34 are parallel and are separated by an interposed gap space 38. The gap space 38 has a uniform width W3 that is slightly larger than the widths W1, W2 of either the first loop structure 26 or the second loop structure 28.

The first loop structure 26 defines the boundaries of a first open central area 40. The second loop structure 28 defines the boundaries of a second open central area 42. The first open central area 40 and the second open central area 42 have the same shape and are concentrically aligned. In the embodiment shown, the loop structures 26, 28, and the open central areas 40, 42 that they define, are all round. Such shapes are arbitrary, and it should be understood that oval shapes and polygonal shapes can be used in alternate embodiments.

A locking tab 44 is positioned in the first open central area 40 of the first loop structure 26. The locking tab 44 is connected to the first loop structure 26 with a flexible hinge connection 46. The flexible hinge connection 46 is preferably a living hinge that enables the locking tab 44 and the first loop structure 26 to be unistucturally molded together as a single unit. The locking tab 44 attaches to the first loop structure 26 at a location opposite of where the first loop structure 26 connects to the base 22. The locking tab 44 has the same shape as the first open central area 40 of the first loop structure 26. In the shown embodiment, that shape is circular. However, the size of the locking tab 44 is smaller than the size of the first open central area 40. In this manner, the locking tab 44 is free to flex on the hinge connection 46 in the first open central area 40.

The locking tab 44, when untouched, is biased into a slight angle of inclination by the hinge connection 46. As a result, the locking tab 44 extends from the hinge connection 46 to a higher free end 48. The result is that the free end 48 of the locking tab 44 extends out of the first open central area 40 to an elevation beyond the flat top surface 34 of the first loop structure 26. The elevated free end 48 of the locking tab 44 faces the base 22 of the buckle construct 20.

Figure 6:
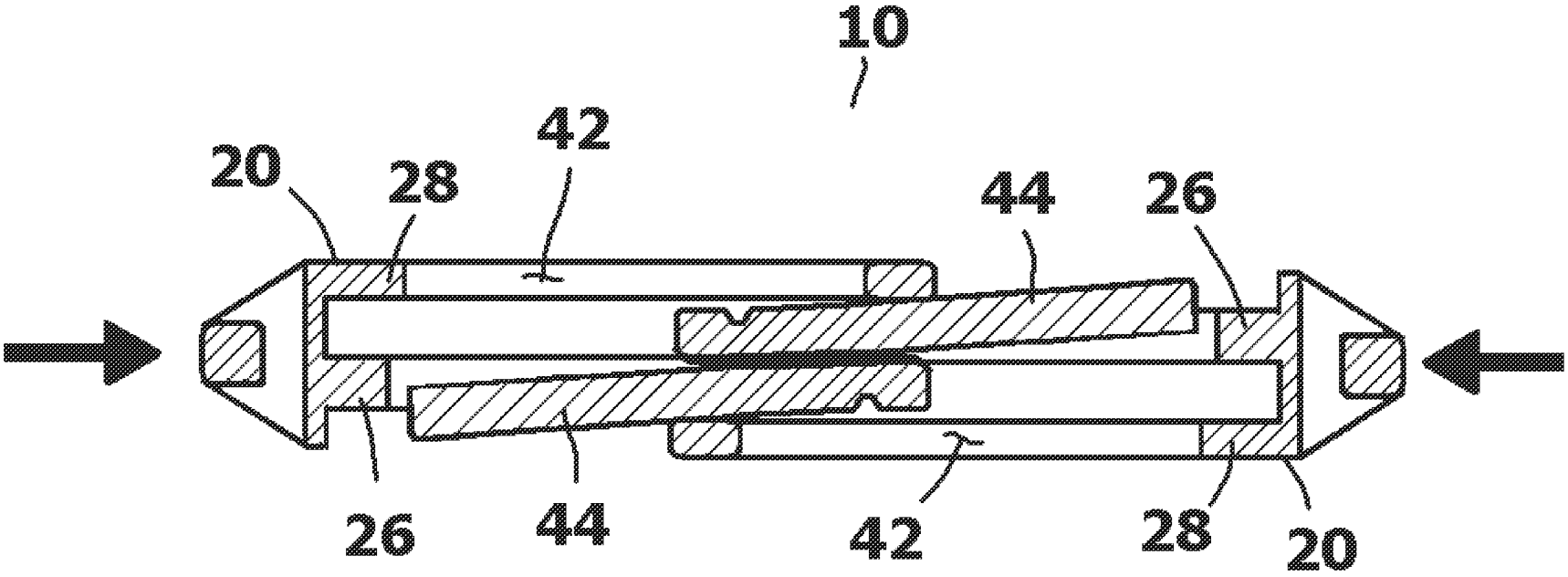
FIG. 6 is a cross-sectional view of the buckle assembly being moved into a closed configuration.
Figure 7:
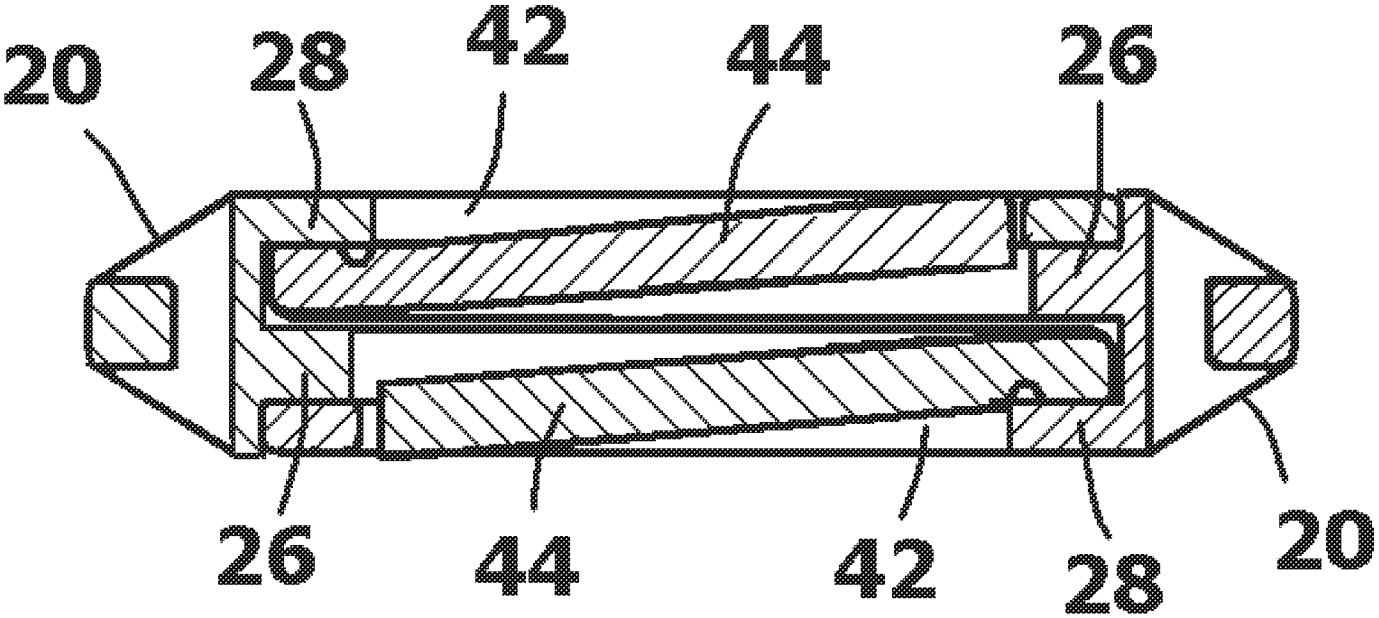
FIG. 7 is a cross-sectional view of the buckle assembly shown in FIG. 2, viewed along section line 7-7.

Referring to FIG. 6 and FIG. 7 in conjunction with FIG. 2, it can be seen that two buckle constructs 20 can be interconnected if the locking tabs 44 are vertically oriented in opposite directions. Once oriented as such, two buckle constructs 20 can be advanced toward each other until the loop structures 26, 28 intermesh and interconnect. The first loop structure 26 of a one buckle construct 20 enters the gap space 38 of the opposite buckle construct 20. As the two buckle constructs 20 are advanced toward each other, the interlacing of the loop structures 26, 28 momentarily flattens the inclination of the locking tab 44 until the two buckle constructs 20 are fully interlaced. Once fully interlaced, the locking tab 44 on a first loop structure 26 is positioned adjacent to the second open central area 42 of a second loop structure 28. The locking tab 44 is then free to return to its inclined orientation within the second open central area 42.

Once the locking tab 44 returns to its inclined orientation, the locking tab 44 cannot be retracted from the second open central area 42. The two buckle constructs 20, therefore, become mechanically interlocked.

Figure 8:
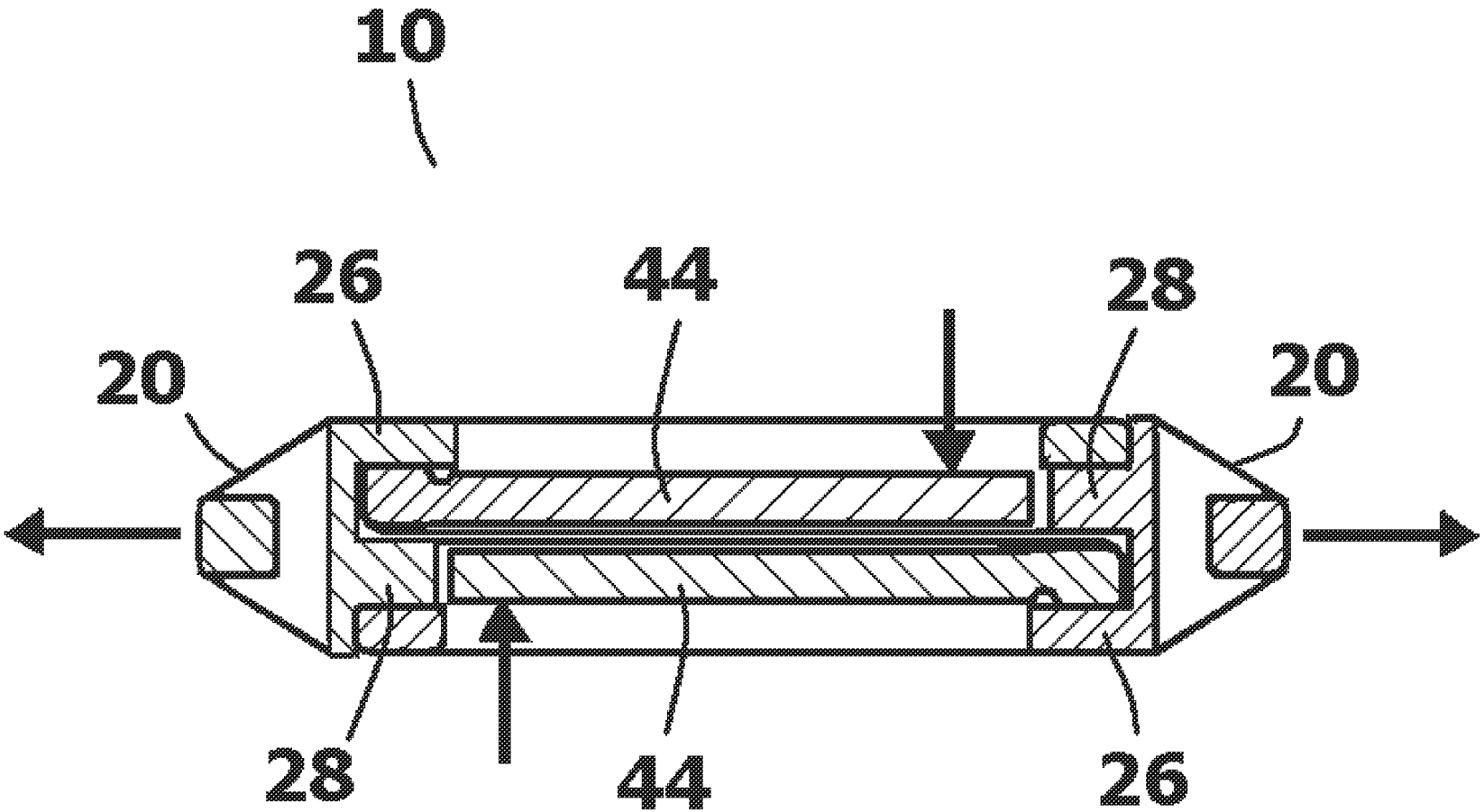
FIG. 8 is a cross-sectional view of the buckle assembly being engaged with forces to open.

Referring lastly to FIG. 8, it can be seen that if compression forces are applied to the locking tabs 44, the locking tabs 44 will deform below the top surface 30 of the first loop structure 26. Once in this deformed position, the locking tabs 44 do not prevent the interlaced loop structures 26, 28 from separating. The interlaced loop structures 26, 28 are then free to pull part, therein separating the two buckle constructs 20 and opening the buckle assembly 10.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A buckle assembly, comprising:

two separate and distinct buckle constructs, wherein each of said buckle constructs has a base and two loop structures extending in parallel from said base, and wherein each of said loop structures has a first loop structure and a second loop structure;

wherein said first loop structure defines a first open area having a locking tab that is disposed in said first open area, said locking tab being attached to said first loop structure with a flexible connection joint;

wherein said loop structures intermesh and interlock when said buckle constructs are brought together; and wherein said buckle constructs are identical in size and configuration.

2. The buckle assembly according to claim 1, wherein said first loop structure has a flat top surface, a flat bottom surface and a width between said flat top surface and said flat bottom surface.

3. The buckle assembly according to claim 2, wherein a gap space is interposed between said first loop structure and said second loop structure, wherein said gap space has a height at least as large as said width of said first loop structure.

4. The buckle assembly according to claim 3, wherein said locking tab is angled relative to said top surface of said first loop structure and has a free end that extends beyond said top surface of said first loop structure.

5. The buckle assembly according to claim 1, further including a strap loop formed in each said base of said buckle constructs.

6. A buckle assembly, comprising:

a first buckle construct having a base, a first loop structure and a second loop structure, wherein said first loop structure defines a first open area and said second loop structure defines a second open area, and wherein said first loop structure and said second loop structure extend in a common direction from said base;

a locking tab connected to said first loop structure, wherein said locking tab extends into said first open area; and a second buckle construct identical to said first buckle construct in size and shape;

wherein said first buckle construct and said second buckle construct selectively intermesh and interlock when said first buckle construct and said second buckle construct are brought together.

7. The buckle assembly according to claim 6, wherein said first loop structure has a flat top surface, a flat bottom surface and a width between said flat top surface and said flat bottom surface.

8. The buckle assembly according to claim 7, wherein a gap space is interposed between said first loop structure and said second loop structure, wherein said gap space has a height at least as large as said width of said first loop structure.

9. The buckle assembly according to claim 7, wherein said locking tab has a free end that extends beyond said flat top surface of said first loop structure.

10. The buckle assembly according to claim 9, wherein said locking tab is attached to said first loop structure within said first open area with a flexible connection joint.

11. The buckle assembly according to claim 6, further including a strap loop formed in said base of said first buckle construct.

* * * * *